2/11/86 CP 4,569,740

United States Patent [19]

Takahashi et al.

[11] Patent Number: 4,569,740

[45] Date of Patent: Feb. 11, 1986

[54] METHOD FOR COATING BY USE OF ELECTRODE

[75] Inventors: Yoshinobu Takahashi, Toyota; Masanori Yokoi, Aichi, both of Japan

[73] Assignee: Toyota Jidosha Kabushiki Kaisha, Toyota, Japan

[21] Appl. No.: 404,752

[22] Filed: Aug. 3, 1982

[51] Int. Cl.[4] ..... C25D 13/04

[52] U.S. Cl. ..... 204/181.7

[58] Field of Search ..... 204/181 C, 290 R, 291, 204/292

[56] References Cited

U.S. PATENT DOCUMENTS

| | | | |
|---|---|---|---|
| 3,960,678 | 6/1976 | Alder | 204/291 |
| 4,200,515 | 4/1980 | Hall et al. | 204/290 R |
| 4,231,854 | 11/1980 | Boehlke et al. | 204/291 |
| 4,236,986 | 12/1980 | Vantini et al. | 204/181 C |
| 4,238,311 | 12/1980 | Kasuya | 204/291 |
| 4,338,510 | 7/1982 | Chihara et al. | 204/292 |

FOREIGN PATENT DOCUMENTS

| | | | |
|---|---|---|---|
| 0028027 | 8/1978 | Japan | 204/291 |
| 0123385 | 10/1978 | Japan | 204/290 R |
| WO83/00511 | 2/1983 | PCT Int'l Appl. | 204/291 |

*Primary Examiner*—Andrew H. Metz
*Assistant Examiner*—Terryence Chapman
*Attorney, Agent, or Firm*—Oblon, Fisher, Spivak, McClelland & Maier

[57] ABSTRACT

An electrode for cation electrodeposition coating which comprises a sintered mass of metal oxide having electroconductivity, such as ferrite or magnetite, and a method for coating by electrodeposition by use of the electrode described above are disclosed.

2 Claims, 3 Drawing Figures

METHOD FOR COATING BY USE OF ELECTRODE

BACKGROUND OF THE INVENTION

This invention relates to an electrode formed of a sintered mass of a metal oxide to be used for coating by cationic electrodeposition and to a method for electrodeposition coating by use of the electrode mentioned above.

In recent years, increasing importance has come to be attached to the improvement in anti-corrosion in the case of coating automobile bodies. The measures for anti-corrosion have been studied in terms of base materials, chemical treatments, types of paints, manners of paint application, automobile body designs, etc. from various angles. Among others, the technique of electrodeposition coating constitutes the most effective and economic method for rendering anti-corrosive the inner surfaces of complicated and hollow structures such as automobile bodies, for example, and even those portions which do not readily permit spray coating. Thus, the electrodeposition coating is extensively used today.

The conventional method for electrodeposition coating has preponderantly used anionic electrodepositing paints in consideration of the low cost of paints so used, the relatively low temperature for baking paints, and the relatively low cost of equipment involved. In accordance with the method for anionic electrodeposition coating, however, the article subjected to coating which is used as an anode is dissolved out in the course of electrodeposition coating, whereas the cathode such as of iron immersed in the electrodepositing cell or paint is not dissolved out. Consequently, the effect of the chemically formed coat is degraded and the thickness of the coat formed on the surface of the article to be coated under treatment is small. Accordingly, with the progressive aggravation of the corrosive environment, it has been proved that the conventional anionic electrodeposition coating is not necessarily satisfactory. For this reason, the technique of cationic electrodeposition coating has recently come to find increasing acceptance.

To effect the cationic electrodeposition coating, a water-insoluble polyamine resin, $R—NH_2$, is obtained by adding a primary amine or secondary amine to the glycidyl group of a water-insoluble resin such as, for example, a bisphenol type epoxy resin thereby effecting ring cleavage thereof, and then an organic acid such as acetic acid or lactic acid is caused to react, as a neutralizing agent (water-solubilizing agent) AH, with the aforementioned water-insoluble polyamine resin to produce an aqueous resin, $R—NH_3^+$, as shown by the following reaction formula (I).

$$R—NH_2+AH \rightarrow R—NH_3^+ + A^- \quad (I)$$

In a cationic electrodepositing paint solution formed of the aforementioned water-soluble resin, and if necessary, a crosslinking agent and a pigment, an article to be coated is immersed as a negatively charged electrode (hereinafter referred to as "cathode"). Separately a positively charged electrode (hereinafter referred to as "anode") such as of stainless steel or carbon is immersed in the same solution. Electric current is passed between the cathode (the article under treatment) and the anode.

By the passage of the electric current, the positively charged paint components electrophoretically migrate in the solution and, on arrival at the article (the cathode) coagulates and precipitates by emitting the electric charges as shown by the following formula (II) and gives rise to a water-insoluble coat on the article.

$$2H_2O+2e^- \rightarrow H_2+2OH^-$$

$$OH^- + R—NH_3 \rightarrow R—NH_2 + H_2O \quad (II)$$

On the anode which is made of a metal such as, for example, stainless steel as indicated in the formula (III), generation of metal ions and simultaneous evolution of oxygen shown by the formula (IV) are observed.

$$M \rightarrow M^{n+} + ne^- \quad (III)$$

$$4OH^- \rightarrow O_2 \uparrow 2H_2O + 4e^- \quad (IV)$$

In case the anode is made of carbon, since it is not a metal, the dissolution indicated by the formula (III) does not occur, but the evolution of oxygen through the reaction of the formula (IV) does occur. Consequently, the carbon of the anode itself is oxidized. Therefore, with the lapse of time, the anode loses its weight and eventually a flaw is developed. Particularly in the case of an anode made of a metal, the metal ions dissolved out from the anode get mixed into the solution. When the paint component is coagulated and precipitated, these metal ions are simultaneously coagulated and precipitated to the article. The coat which is consequently obtained suffers from poor anti-corrosion property or coarse coating surface. In the case of an anode made of carbon, the oxidation causes the anode to shed fine carbon particles into the solution. If the electrodeposition coating is continued with carbon particles contained in the solution, gritty prominences stand out on the surface of the coated article, with the rsult that the produced coat suffers from inferior appearance and deficient anti-corrosion property.

As materials for the anode which avoid release of metal ions, the use of high-grade stainless steel of SUS-316 or the like, or a noble metal such as platinum may be considered. Stainless steel, in addition to being expensive, is inevitably susceptible to release of metal ions, if only to a slight extent. The noble metal is too expensive to be feasible for the use contemplated. Carbon and graphite have a problem that they have poor processibility.

SUMMARY OF THE INVENTION

This invention is directed to solving the aforementioned problems suffered by the prior art and is aimed at the adoption, as a material for the anode, of a sintered mass of a metal oxide which is indissolvable or sparingly dissolvable and is an electric conductor. It is also aimed at disclosing a specific construction of the anode using a sintered mass of a metal oxide having poor moldability and processibility.

The method for the cationic electrodeposition coating according to the present invention comprises the steps of placing an article subjected to coating in a paint solution, placing paired electrodes as opposed to the article in the paint solution, and applying a DC voltage between the article and the paired electrodes thereby forming on the surface of the article a coat of cationic electrodeposit, and is characterized by using, as the material for the paired electrodes mentioned above, a sintered mass of electroconductive metal oxide.

BRIEF DESCRIPTION OF THE DRAWINGS

These and other objects and advantages of the present invention will be well appreciated when preferred embodiments of the present invention is considered in conjunction with the attached drawings in which.

DETAILED DESCRIPTION OF THE PREFERRED EMBODIMENTS OF THE INVENTION

Figure 1:
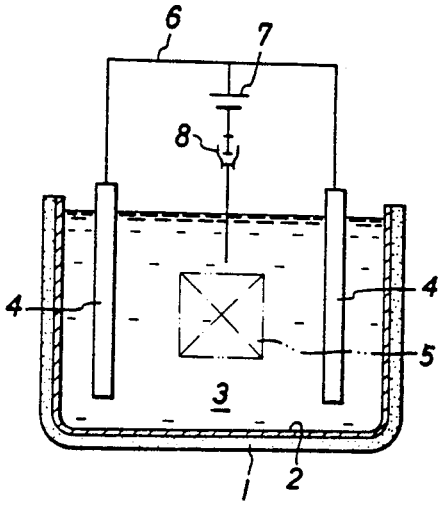
FIG. 1 is a lateral cross section view illustrating a system for carrying out the method for cationic electrodeposition coating.

The sintered mass of metal oxide which is used for the paired electrodes, i.e. anodes, in the present invention abounds with electroconductivity. Typical examples of the sintered mass are a magnetic iron oxide represented by $FeO—Fe_2O_3$ which is popularly called magnetite and a magnetic metal oxide represented by $MO.nFe_2O_3$ which is called ferrite. In the formula, M denotes a divalent metal ion such as of Mn, Ni, Cu, Mg, Co, or Zn.

Because of the intended purpose, the sintered metal mass to be used in this invention is required to possess electric conductivity.

In the case of the aforementioned magnetite, since the specific resistance is sufficiently low, the electric conductivity does not pose any serious problem. In the case of the ferrite, the specific resistance is fairly variable with the composition. Generally, ferrites possess ferromagnetism. The ferrites of the type which are now used in the electronic industry as various transformers, permanent magnets, memory elements, and magnetic elements in televisions, radios, audio devices, and telecommunication devices possess varying specific resistances within a wide range of 100 Ω.cm to 100 MΩ.cm. Among ferrites, some of those having large values of specific resistance may suffer from decline of current and evolution of heat and, consequently, prove to be unfit for use as anodes. The ferrite to be used as the material for the anode in the present invention is required to possess a low degree of specific resistance. In the ferrite, the electric conduction is preponderantly caused by the hopping of electrons between $Fe^{2+}$ and $Fe^{3+}$. For making the ferrite possess a low degree of specific resistance, therefore, the composition of the ferrite must be excessively rich in $Fe_2O_3$. The sintered mass of metal oxide to be used as the anode for the cationic electrodeposition coating according to the presnet invention is desirably such a composition that the value of the volume specific resistance, determined in accordance with the specification of ASTM D 257-61, is not more than $10^5$ Ω.cm, preferably not more than $10^3$ Ω.cm and more preferably not more than 0.3 Ω.cm, at a temperature of 20° C. and a load voltage of 20 V. Specifically, this is a sintered mass of metal oxide having a spinel crystalline structure wherein iron oxide and metal oxides other than iron oxide (such as NiO, MnO, CoO, MgO, CuO, ZnO and CdO, for example) are combined in a specific mixing ratio, e.g. 5 to 40 mol%, preferably 20–40 mol%, and more preferably about 40 mol% of such other metal oxides based on the total including iron oxide ($Fe_2O_3$).

In the case of a magnetic iron oxide, it is desired to be composed of 30 to 50% of FeO and 50 to 70% of $Fe_2O_3$, preferably 35 to 45% of FeO and 65 to 55% of $Fe_2O_3$. A sintered mass composed of 44.0% of FeO, 53.5% of $Fe_2O_3$, 1.0% of $SiO_2$, 0.9% of $Al_2O_3$, 0.5% of CaO and 0.1% of MgO is employed as one of most preferable metal oxide.

The anti-corrosion property of the aforementioned magnetic iron oxide and ferrite as an anode excels that of the conventional material for the anode such as stainless steel (SUS 304, SUS 316, SUS 317) or carbon like graphite. Particularly, the ferrite is desirable because it sparingly dissolves out.

The metal oxide electrodes are known and the manufacturing processes thereof are also known, for instance, from Japanese Patent Publication Nos. 30151/1977 and 35394/1976. The electrode according to the present invention can be therefore produced using the aforementioned magnetic iron oxide or ferrite in accordance with the conventional processes.

Illustrative of such producing processes is one in which 5 to 40 mol% of at least one of metal oxides of MO (M denotes Mn, Ni, Co, Mg, Cu, Zn, or Cd) is added to 95 to 60 mol% of $Fe_2O_3$; heating is carried out in the air at 800° to 1000° C. for 1 to 3 hours after mixing in a ball mill; and the milled mass as cooled is crushed to obtain fine powder. The fine powder is molded under pressure, or a muddy substance obtained by adding water to this fine powder is cast-molded after pouring into a mold or by an appropriate method such as extrusion to obtain a desired shape of a molded product. The molded product thus obtained is sintered in an inert gas containing less than 5 vol. % of $O_2$, for instance, in the $N_2$ or $CO_2$ atmosphere at 1300° to 1400° C. for 3 to 5 hours and then gradually cooled in an inert gas containing less volume of $O_2$, such as $N_2$ or $CO_2$ atmosphere to obtain the intended electrode. The electrode thus obtained has a relatively high mechanical strength and exhibits the specific resistance fallen within the above-mentioned range.

In the above, although $Fe_2O_3$ and MO (M being the same as given above) are employed as starting materials, instead of $Fe_2O_3$, there may be employed at least one kind of Fe, FeO and $Fe_2O_3$ in such an amount that the amount is 95 to 60% when calculated as $Fe_2O_3$. Further, instead of the oxide such as MO, there may be employed a compound such as carbonate and oxalate which can produce their oxide upon heating.

The magnetic electrode can be obtained by the similar manner as mentioned above. For instance, pure $Fe_3O_4$ as starting material together with polyvinylalcohol as binder are granulated and then molded, followed by solid phase-sintering at an inert atmospher such as $CO_2$ gas at 1200° to 1300° C. to obtain the intended electrode.

BEST MODE OF THE INVENTION

Now, the present invention will be described below with reference to working examples and controls. The value of each volume specific resistance given in these examples and controls were those obtained by the measurement carried out at 20° C. and 20 V in accordance with the method of ASTM D257-61.

EXAMPLE 1

(A) Preparation of anode plate

Anode plates having 160 mm in length, 50 mm in width, and 4 mm in thickness were prepared through sintering using magnetic iron oxide ferrites A through D having different values of volume specific resistance. The volume specific resistance values of the sintered masses (anode plates) thus obtained were as shown in Table 1-1.

TABLE 1-1

| Electrode | Component | | |
|---|---|---|---|
| | $Fe_2O_3$ | NiO | MnO |
| Ferrite A | 53 mol % | 30 mol % | 17 mol % |
| Ferrite B | 53 mol % | 37 mol % | 10 mol % |
| Ferrite C | 55 mol % | 45 mol % | 0 mol % |
| Ferrite D | 60 mol % | 40 mol % | 0 mol % |

Fine powder is produced by mixing at least two of NiO and MnO together with $Fe_2O_3$ at the above-showed ratios; well mixing them, for instance, in a ball mill; heating the mixture in the air at 800° to 1000° C. for 1 to 3 hours; and crushing the mass thus obtained after cooling. A muddy substance obtained by adding water to the fine powder is extrusion-molded into a desired shape of a molded mass. Then, the molded mass is sintered at 1300° to 1400° C. in the $N_2$ atmosphere containing less than 2 vol. % of $O_2$ for 3 to 5 hours and cooling is effected gradually in the $N_2$ gas containing less volume of $O_2$ to obtain the intended electrode.

(B) Electrodeposition Coating (1) Preparation of paint

Epoxy type polyamino resin having a resin base number 80 was neutralized at a neutralization equivalent 0.5 with acetic acid and dissolved in a deionized water containing ethylene glycol monoethyl ether acetate to produce varnish. The varnish thus prepared and 3 parts of carbon black and 6 parts of talc both based on 100 parts of the solid content of the varnish were subjected to dispersion in a mill for 20 hours to produce a cationic electrodepositing paint. The paint thus obtained was diluted with deionized water to a solid content of 12%.

(2) Method of coating

As illustrated in FIG. 1, a container which was obtained by providing a vinyl chloride resin lining 2 for a tank 1 of steel plate measuring 200 mm in length, 110 mm in width, and 150 mm in depth was filled with the paint solution 3 prepared as described above. Then, the sintered ferrite plates (paired electrodes) 4, 4 prepared as described in (A) above were fixed in the bath while their portions 10 mm downward from their respective upper ends stood over from the surface of the bath, whereas an article 5 to be coated which is made of steel plate treated with zinc phosphate (a cold-rolled steel plate SPC of 150×50×0.8 mm treated in advance with Bonderite #137 made by Nihon Parkerizing Co., Ltd.) was immersed in the aforementioned bath. The two paired electrodes 4, 4 were disposed symmetrically about the article 5 under treatment so that a coat would be uniformly formed on the article 5. These paired electrodes 4, 4 were interconnected with a lead wire 6. Further, the article 5 was electrically connected via a contact 8 to a power supply 7 which in turn was connected to the aforementioned lead wire 6. With the bath kept in the state described above, electric current was passed under the following conditions. The paired electrodes 4, 4 were positively charged and used as anodes and the article 5 used as a cathode, with the result that the cationic paint was deposited on the surface of the article 5.

| (Electrodeposition conditions) | |
|---|---|
| Bath temperature | 30° C. |
| Distance between electrodes | 150 mm |
| Anode area | 75 $cm^2$ |
| Cathode area | 75 $cm^2$ |
| DC voltage | 130 V and 160 V |
| Period of current flow | 3 minutes |

After the electrodeposition coating, tap water at 20° C. was sprayed under pressure of 0.5 $kg/cm^2$ to wash the coated article for one minute. Then, the baking-curing was effected at 180° C. for 30 minutes. The electrodeposition coating was similarly conducted using the anodes produced from the different raw materials and the value of initial current and thickness of each coat were determined. The results were as shown in Table 1-2.

Control 1

Similarly with the procedure of Example 1 (B), the electrodeposition coating was carried out by using carbon (graphite electrode made by Tokai Carbon Co., Ltd. and marketed under trademark "G 152") and stainless steel SUS 316 as materials for paired electrodes (anodes). With the use of the above anodes, the value of initial current at the electrodeposition and thickness of each coat were determined. The results were as shown in Table 1-2.

TABLE 1-2

| Voltage | Material anode | Example | | | | | | Control 1 |
|---|---|---|---|---|---|---|---|---|
| | | Example 1 | | | | | | |
| | | Magnetic iron oxide | Ferrite A | Ferrite B | Ferrite C | Ferrite D | Carbon | Stainless steel SUS 316 |
| 130 V | Thickness of deposited coat (μ) | 15 | 10 | 14 | 15 | 15 | 14 | 15 |
| | Value of initial current (A) | 2.0 | 1.1 | 1.8 | 1.8 | 1.9 | 1.8 | 1.9 |
| 160 V | Thickness of deposited coat (μ) | 21 | 16 | 19 | 20 | 20 | 20 | 20 |
| | Value of initial current (A) | 2.2 | 1.3 | 2.0 | 2.1 | 2.2 | 2.2 | 2.2 |
| Value of volume specific resistance | | less than $1 \times 10^{-1}$ | $2 \times 10^5$ | $1 \times 10^3$ | 90 | 0.3 | — | — |

TABLE 1-2-continued

| | | Example | | | | | | |
|---|---|---|---|---|---|---|---|---|
| | | Example 1 | | | | | | Control 1 |
| Voltage | Material anode | Magnetic iron oxide | Ferrite A | Ferrite B | Ferrite C | Ferrite D | Carbon | Stainless steel SUS 316 |
| (Ω · cm) | | | | | | | | |

Example 2

(A) Preparation of anode plate

Similarly with the procedure of Example 1 (A), anode plates were made by using magnetic iron oxide and ferrite D.

(B) Method for test for anti-corrosiveness

A 5 wt. % solution of acetic acid diluted with deionized water and a 5 wt. % solution of lactic acid diluted with deionized water were mixed at a mixing ratio of 1:1. The resultant mixture was placed in the similar container with a resin lining to that used in Example 1 (B). In the bath, the paired anode plates prepared as described in (A) above were set in such a position that their portions 10 mm downward from their respective upper ends stood out over the surface of the bath and a cold rolled SPC steel plate was set therein as a cathode. Electrolysis was carried out under the following conditions. The anode plates were tested for anticorrosiveness, with the loss of weight of each anode. The amounts of dissolution thus determined were as shown in Table 2-1.

| (Conditions of electrolysis) | |
|---|---|
| Bath temperature | 30° C. |
| Distance between anodes | 150 mm |
| Area of anodes and cathodes | 75 $cm^2$ |
| DC current | 5 $A/dm^2$ and 0.01 $A/dm^2$ alternately used at intervals of 1 hour. |
| Period | 100 to 1000 hours. |

Control 2

The same carbon and stainless steel SUS 316 as involved in Control 1 were used as anode and the anodes were tested for anti-corrosiveness by following the procedure of Example 2 (B). The amounts of anodes dissolved out in the test were as shown in Table 2-1.

TABLE 2-1

| Material of anode | Amount dissolved out (g/A. year) |
|---|---|
| Magnetic iron oxide | 50 |
| Ferrite E | 0.5 |
| Stainless steel SUS 316 | 10,000 |
| Carbon (graphite) | 1,000 |

Similarly to the above test, there were measured the dissolved amounts and resistances of electrode of nickel-ferrite ($Fe_2O_3$—NiO) in which the mol% of NiO is varied in the range of 5 to 45 mol%, the results being shown in Table 2-2.

The electrodes in this test were produced similarly in Example 1.

TABLE 2-2

| | NiO (mol %) | Dissolved-out amount (g/A. year) | Resistance (Ω. cm) |
|---|---|---|---|
| Ferrite D | 40 | 0.5 | 0.3 |
| Ni-ferrite I | 30 | 1.0 | 0.07 |
| Ni-ferrite II | 20 | 2.0 | 0.03 |
| Ni-ferrite III | 10 | 4.5 | 0.02 |
| Ni-ferrite IV | 5 | 7.0 | 0.01 |
| Ni-ferrite V | 2 | 12.0 | 0.005 |
| Ni-ferrite VI | 43 | 0.3 | 3.0 |
| Ferrite C | 45 | below 0.1 | 90.0 |

It is seen from Table 2-2 that 5–10 mol% of NiO is more excellent.

Example 3

Figure 2:
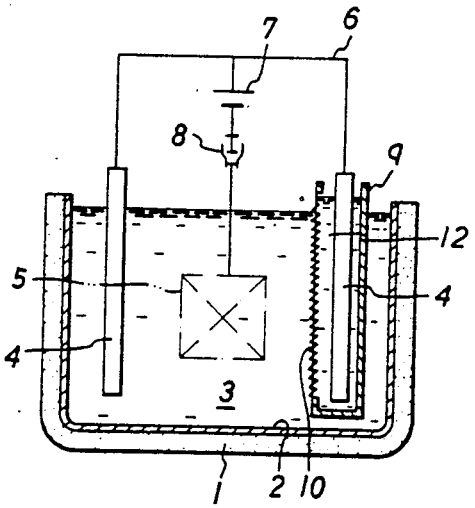
FIG. 2 is a lateral cross section view illustrating another system for carrying out the method for cationic electrodeposition coating.

In a field electrodeposition coating line, as illustrated in FIG. 2, a container in which a lining 2 such as of vinyl chloride is provided on the inner surface of a tank 1 of steel plate was filled with a paint solution 3. This paint had substantially the same composition as described in Example 1 (B). In the paint solution 3, the anode plates 4, 4' and an article 5 to be coated were immersed, with the anode plates 4, 4' connected to the anode of a DC power supply 7 by means of a lead wire 6 and the article 5 to the cathode of the power supply via a contact 8. In the present example, the anodes were used as a bare electrode construction illustrated in FIG. 1 and as a diaphragmed electrode construction. Specifically, the latter construction was obtained by setting up a diaphragm box 9 round the anode plate 4', disposing an ion-exchange resin membrane 10 in the plate of the diaphragm box 9 intervening between the anode plate 4' and the article 5 under treatment, and placing a diaphragm water 12 to fill the box 9. If the anode is formed in such a diaphragm-electrode construction as described above, the coat of electrodeposit is produced with improved quality because even if the material of the anode dissolves out slightly from the anode, the dissolved material is prevented from mingling into the paint solution.

Figure 3:
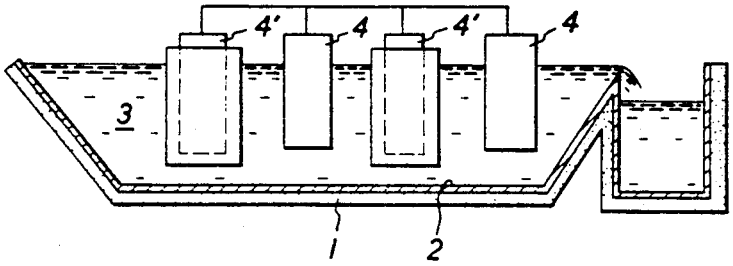
FIG. 3 is a longitudinal cross section view of yet another system for carrying out the method for cationic electrodeposition coating.

FIG. 3 illustrates the location of anodes in the longitudinal direction of an electrodepositing cell. In the figure, 4 denotes an anode in a bare construction and 4' an anode in a diaphragm-electrode construction.

Electrodeposition coating was carried out by following the procedure described in Example 1 (B) under the conditions described similarly. As materials for the anodes in this example, there were used stainless steel (SUS 316), carbon (graphite), and ferrite D.

The anodes made of these materials were operated for electrodeposition coating for a period of about one year. The weight reduction of each anode plate was measured. The results were as shown in Table 3. It is noted from this table that the anodes using ferrite suffered the least loss of weight. As regards the quality of coat of electrodeposit, while the coat produced by using the ferrite anodes posed no noticeable problem, that produced by using stainless steel anodes was found to have an increased Fe ion content and showed a rather coarse skin. In the case of the coat produced by using anodes of carbon, a part of carbon fell off and the paint solution was consequently found to contain finely divided particles of carbon, with the result that the produced coat suffered from a poor appearance.

TABLE 3

| Material of anode | Reduction in thickness (mm/year) |
|---|---|
| Ferrite | Less than 0.1 |
| Carbon | 1.0 |
| Stainless steel (SUS 316) | 3.0 |

From the foregoing description, it is clear that the cationic electrodeposition coating involved in this example entailed virtually no dissolution of the electrode during the electrodeposition because the anode plates were formed by using a sintered mass of metal oxide excelling in electroconductivity and that, consequently, there was no possibility that ions as impurity would mingle into the paint solution. Since the anodes were not oxidized by the oxygen generated near the anodes during the electrodeposition, there was no possibility that the anodes would be degraded by oxidation or partially separated off. Thus, the paint solution was free from adulteration with impure fine particles and the formed coat acquired a smooth, flawless skin. Furthermore, since the anodes were not degraded, they enjoyed increased durability, obviated the necessity for replacement, and acquired a merit of economizing both cost and labor.

Having thus described the invention, what is claimed as novel and described to be secured by Letters Patent of the United States is:

1. A process for cationic-electrodeposition coating, comprising:

(a) immersing an object to be coated and a pair of electrodes opposing said object into a coating solution, said coating solution being an epoxy type polyamino resin based coating in combination with an organic acid as a neutralizer; and (b) impressing d.c. voltage between the object and the electrodes to form a cationic deposition coating film on the surface of the object, wherein said electrodes consists essentially of a conductive, sintered metal oxide mass which consists essentially of 30 to 50% FeO and 50 to 70% $Fe_2O_3$, and wherein said metal oxide mass has a volume specific electric resistance of less than $10^5$ ohm.cm at a temperature of 20° C. and a load voltage of 20 volts.

2. A process for cationic-electrodeposition coating, comprising:

(a) immersing an object to be coated and a pair of electrodes opposing said object into a coating solution, said coating solution being an epoxy type polyamino resin based coating in combination with an organic acid as a neutralizer; and (b) impressing d.c. voltage between the object and electrodes to form a cationic deposition coating film on the surface of the object, wherein said electrodes consist essentially of a conductive, sintered metal oxide mass which consists essentially of 95 to 60 mol % $Fe_2O_3$ and 5 to 40 mol % of one or more other metal oxides selected from the group consisting of MnO, NiO, CuO, MgO, CoO and ZnO, and wherein said metal oxide mass has a volume specific electric resistance of less than $10^5$ ohm.cm at a temperature of 20° C. and a load voltage of 20 volts.

* * * * *